US007931572B1

(12) United States Patent
Glauser et al.

(10) Patent No.: US 7,931,572 B1
(45) Date of Patent: Apr. 26, 2011

(54) RESISTANCE EXERCISE DEVICE

(76) Inventors: Kyler Ross Glauser, Saint George, UT (US); Jennifer Ruth Glauser, Saint George, UT (US)

( * ) Notice: Subject to any disclaimer, the term of this patent is extended or adjusted under 35 U.S.C. 154(b) by 0 days.

(21) Appl. No.: 12/631,433

(22) Filed: Dec. 4, 2009

(51) Int. Cl.
*A63B 721/02* (2006.01)

(52) U.S. Cl. ..... 482/126

(58) Field of Classification Search ..... 482/121–130, 482/907–908, 139, 44, 148, 140, 51, 92, 482/47–48, 91, 904; 119/769–770, 795–798, 119/805, 792; 24/265 R, 300–301, 594.11
See application file for complete search history.

(56) References Cited

U.S. PATENT DOCUMENTS

| | | | | |
|---|---|---|---|---|
| 1,402,179 | A * | 1/1922 | Piscitelli | 482/124 |
| 1,432,013 | A * | 10/1922 | Blake | 482/124 |
| 3,415,515 | A | 12/1968 | Otto | |
| 4,090,706 | A * | 5/1978 | Reda | 482/122 |
| 4,441,707 | A * | 4/1984 | Bosch | 482/131 |
| 4,540,173 | A * | 9/1985 | Hopkins, Jr. | 482/124 |
| 4,733,862 | A | 3/1988 | Miller | |
| 4,779,867 | A | 10/1988 | Hinds | |
| 4,852,874 | A * | 8/1989 | Sleichter et al. | 482/122 |
| 5,141,223 | A * | 8/1992 | Block | 482/124 |
| 5,176,602 | A | 1/1993 | Roberts | |
| 5,234,395 | A * | 8/1993 | Miller et al. | 482/118 |
| 5,328,432 | A * | 7/1994 | Gvoich | 482/118 |
| 5,514,059 | A | 5/1996 | Romney | |
| 5,549,532 | A | 8/1996 | Kropp | |
| 5,800,322 | A | 9/1998 | Block | |
| 5,885,196 | A * | 3/1999 | Gvoich | 482/125 |
| 6,202,263 | B1 | 3/2001 | Harker | |
| 6,267,711 | B1 | 7/2001 | Hinds | |
| 6,322,483 | B1 | 11/2001 | Rotella | |
| 6,348,026 | B1 | 2/2002 | Kuo | |
| 6,524,226 | B2 | 2/2003 | Kushner | |
| 6,648,804 | B2 * | 11/2003 | Chen | 482/125 |
| 6,659,921 | B2 * | 12/2003 | Vernon | 482/124 |
| 6,672,997 | B1 * | 1/2004 | Winkler | 482/126 |
| 6,691,318 | B1 * | 2/2004 | Davis | 2/102 |
| 6,860,841 | B1 | 3/2005 | Mortorano | |
| 7,175,574 | B2 * | 2/2007 | Carmel et al. | 482/124 |
| 7,448,990 | B2 * | 11/2008 | Wu | 482/121 |
| 7,503,883 | B2 | 3/2009 | Madden | |
| 2002/0187884 | A1 | 12/2002 | McGrath | |
| 2004/0152569 | A1 | 8/2004 | Lerner | |
| 2004/0259702 | A1 * | 12/2004 | Tung | 482/126 |
| 2006/0127247 | A1 * | 6/2006 | Caddell | 417/413.1 |
| 2007/0155600 | A1 | 7/2007 | Cunningham et al. | |
| 2007/0219074 | A1 * | 9/2007 | Pride | 482/124 |
| 2008/0108486 | A1 * | 5/2008 | Vigilia | 482/124 |

* cited by examiner

*Primary Examiner* — Lori Baker

(57) ABSTRACT

A resistance exercise device includes at least one stretchable resistance loop, a pair of handles having openings extending longitudinally therethrough, and a support portion having a pair of openings extending therethrough along opposing edges of the support portion. The support portion is located between the first and second handles.

7 Claims, 4 Drawing Sheets

RESISTANCE EXERCISE DEVICE

CROSS REFERENCE TO RELATED APPLICATIONS

None.

STATEMENT REGARDING FEDERALLY SPONSORED RESEARCH AND DEVELOPMENT

None.

TECHNICAL FIELD

The present invention relates to the use of a resistance exercising and strengthening device. The present invention relates particularly to strengthening the upper body using a resistance device, namely a band having the ability to create resistance from two different directions allowing for balanced muscle involvement.

BACKGROUND OF THE INVENTION

Resistance bands are used in large part for strengthening and conditioning the muscles of the body. The bands can be used in many different ways to target different muscles. Bands can be used singly, grouped, or with accessories that allow the user to attach one or more bands to a stationary object, such as a door for example.

Use of rubber and latex resistance exercise cords in connection with a wide variety of exercises is well known in the health and fitness industry. Typical rubber resistance exercise cords are in the form of hollow tubes that provide resistance in response to stretching of the cords. The amount of resistance typically depends upon the thickness of the tubes. Handles or other structures are secured to the resistance cord to provide exercise features and options.

A problem associated with many resistance bands found in the art is that they tend to rub against the neck of the user and put a lot of pressure on the user's neck during ordinary use of the device. Existing bands may also rub against the user's arms and back, causing further discomfort during use of the device. Further, existing resistance bands typically include a single band with handles on terminating ends of the band. This limits the resistance and adds to the tendency of such bands to rest on body parts and repetitively rub against those body parts. Devices known in the art also typically include a resistance band that provides resistance from only one direction, under the arm of the user. This can result in unbalanced chest muscle development on the part of the user.

BRIEF SUMMARY OF THE INVENTION

The present invention provides a resistance exercise device that includes at least one stretchable resistance loop, a pair of handles having openings extending longitudinally therethrough, and a support portion having a pair of openings extending therethrough along opposing edges of the support portion. The support portion is located between the first and second handles.

In another aspect of the present invention, the resistance exercise device includes a rigid support extending along at least a portion of a length of the support portion In another aspect of the present invention, the at least one stretchable resistance loop is a single, unitary construction.

In still another aspect of the invention, the at least one stretchable resistance loop is formed from a length of material the ends of which are joined together at a joint.

Another aspect of the present invention provides a resistance exercise device that includes a first stretchable resistance cord with first and second opposing ends, a second stretchable resistance cord with first and second opposing ends, a first handle attached to the first end of the first stretchable resistance cord and the first end of the second stretchable resistance cord, a second handle attached to the second end of the first stretchable resistance cord and the second end of said second stretchable resistance cord, and a support portion attached to the first and second stretchable resistance cords and extending therebetween.

Yet another aspect of the present invention provides that the support portion includes first and second sleeves extending along opposing ends thereof, the sleeves being adapted to allow said stretchable resistance cords to move freely therethrough and to remain fixed in position when in a relaxed state.

In still another aspect of the present invention, the support portion includes a rigid support extending along at least a portion of a length thereof.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Though some features of the invention may be claimed in dependency, each feature has merit when used independently.

BRIEF DESCRIPTION OF THE DRAWINGS

Further features of the present invention will become apparent to those skilled in the art to which the present invention relates from reading the following description with reference to the accompanying drawings, in which.

DETAILED DESCRIPTION OF THE INVENTION

Figure 1:
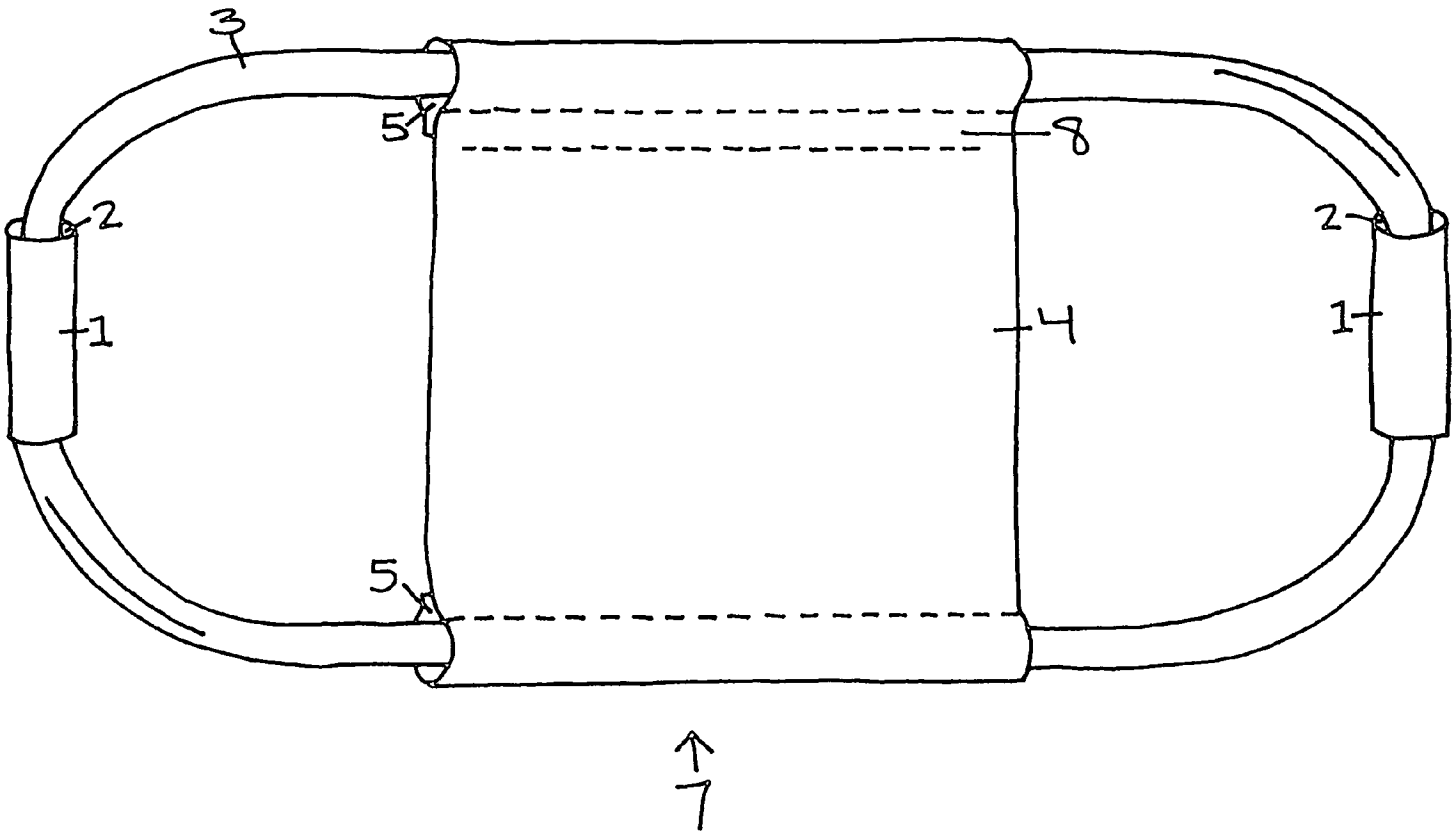
FIG. 1 is a perspective view of a resistance exercise device in accordance with an embodiment of the present disclosure, illustrating the cord of the resistance device in a relaxed state from the front view.
Figure 2:
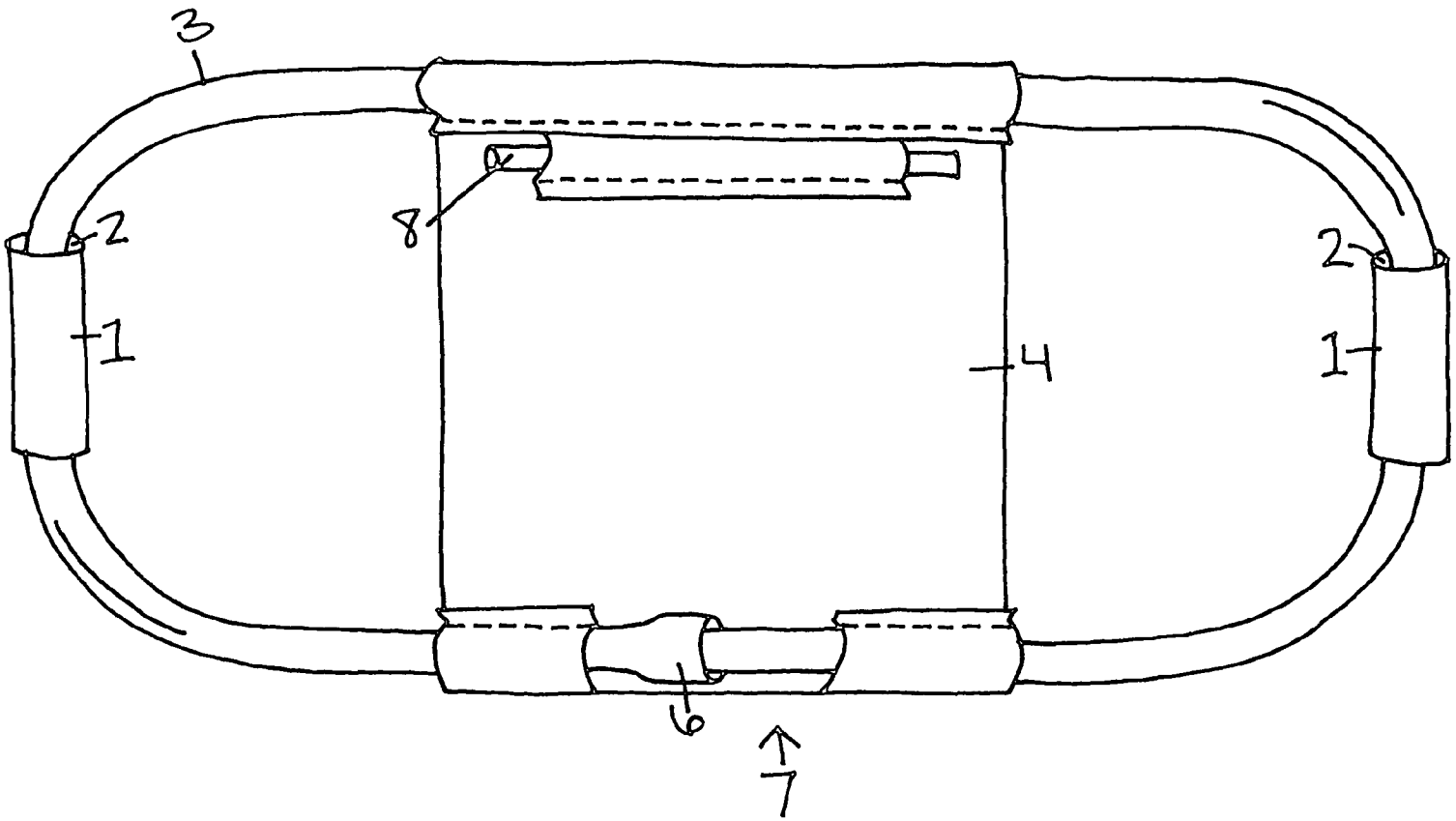
FIG. 2 is a perspective view of the resistance exercise device of FIG. 1 illustrating the posterior view of the present disclosure.

The invention will now be described with reference to the drawing figures, in which like reference numerals refer to like parts throughout. While the present disclosure may be susceptible to embodiment in different forms there is shown in the drawing, and herein will be described in detail, an embodiment with the understanding that the present description is to be considered an exemplification of the principles of the disclosure and is not intended to limit the disclosure to the details of construction and the arrangements of components set forth in the following description or illustrated in the drawing.

FIGS. 1-4 illustrate a resistance exercise device 7 in accordance with an embodiment of the present disclosure. The illustrated resistance exercise device 7 comprises a cord 3 with the ends connected at a joint 6, thereby forming a loop. A pair of hollow handles 1, and two sleeves 5, one on either end of the support portion 4, between the two handles 1. The resistance cord 3 runs within both the sleeves 5 and handle pairs 1.

Figure 3:
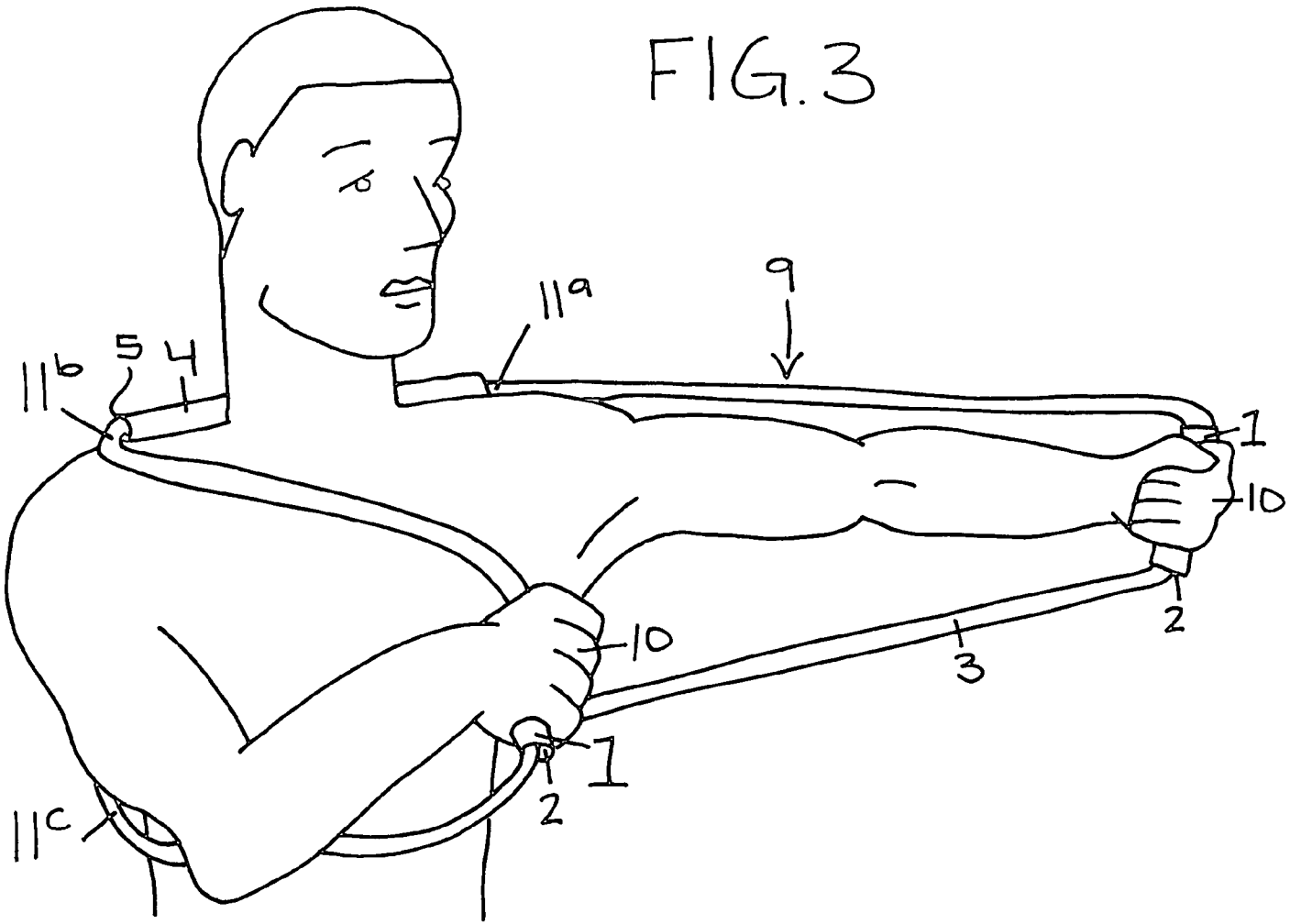
FIG. 3 is a perspective view of the resistance exercise device of FIG. 1 illustrating the cord pulled in use by a user to the stretched state on one side of the embodiment from a front/side view.
Figure 4:
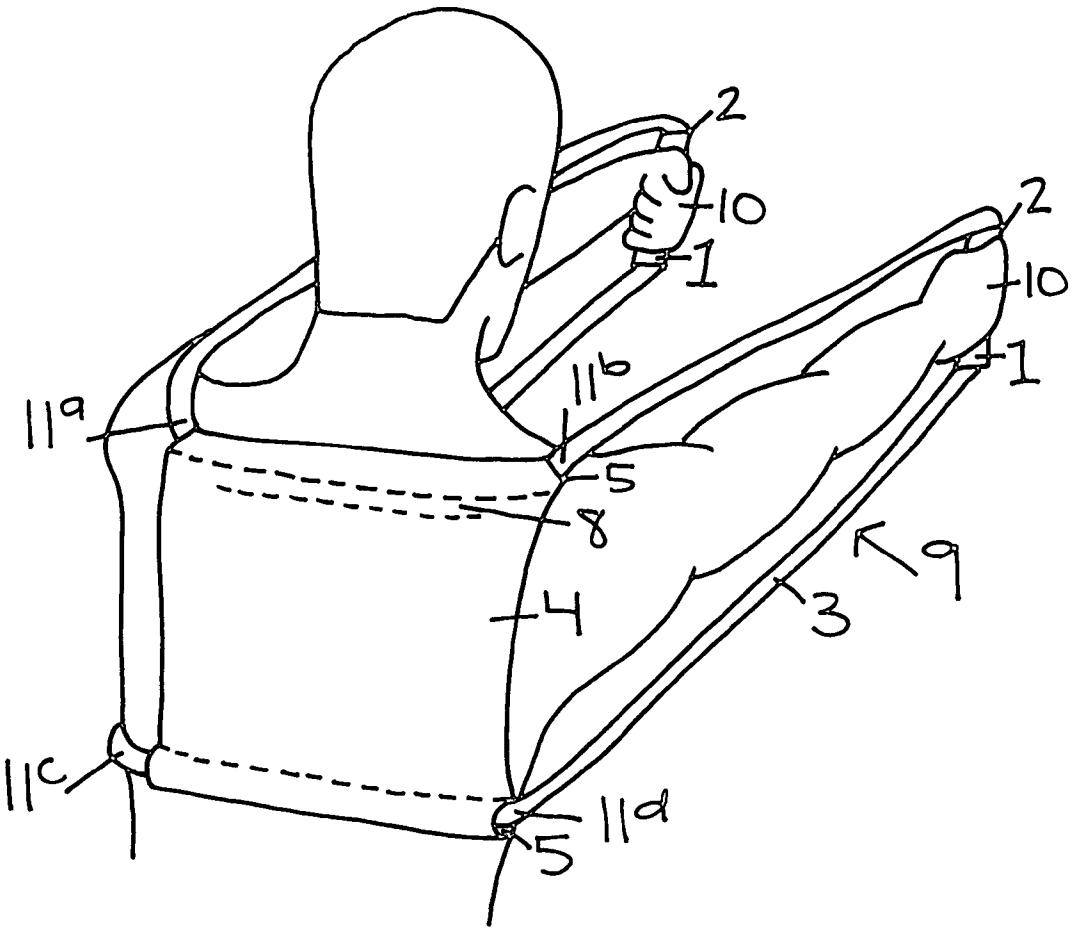
FIG. 4 is a perspective view of the resistance exercise device of FIG. 1 illustrating the cord being pulled in use by a user to the full stretched state on both sides of the embodiment from a posterior view of the user.

The cord 3 is shown in a relaxed state in FIG. 1, but can be stretched by application of any suitable pulling force during any type of exercise as shown, for example, in FIG. 3 and FIG. 4, to extend the length 9 of the cord 3. The extent of stretching of the cord 3 depends upon the magnitude of the pulling force and the resistance of the cord 3.

The illustrated resistance cord 3 may have any suitable construction, configuration and dimensions. The resistance cord 3 may, for example, be any commercially available elastic resistance cord. The thickness of the cord 3 affects the amount of resistance provided by the cord 3 during exercise. The ends of the cord 3 are conjoined at a joint 6 so the resistance cord 3 is a full loop.

The pair of handles 1 may have any suitable construction, configuration and dimensions. Cord 3 may extend through the inner hollow space 2 of the handles 1. The handles 1 are a place where the user can grip the present device to perform the exercises 10. In the illustrated embodiment, for example, each handle 1 comprises a slightly rigid section of tubing where the handles 1 are loose to move freely along the cord 3.

Support portion 4 of the present device may be constructed of any suitable material, configuration and dimensions, and support portion 4 may include two sleeves 5, each at an opposing end of support portion 4, the size adapted so as to allow resistance cord 3 to run through sleeves 5. In the embodiment of the present device shown in the drawings, there are two sleeves 5 for keeping separate the opposite ends of the resistance cord 3 contained within the sleeves 5. The support portion 4 functions as a tool to direct the cord 3 at four intended points 11*a*, 11*b*, 11*c*, 11*d* and to appropriately separate the cord 3 in a useful way within the sleeves 5. It is contemplated that the present device may be modified to include a single sleeve 5 or more than two sleeves 5.

Enclosed within one of the sleeves 5 is a straight length of material (rigid support 8) extending along at least a portion of the length of the sleeve that may have any suitable construction, configuration and dimension, and that is rigid to prevent the resistance cord 3 from bending at a single point, for example, directly around the neck. The rigid support 8 causes the resistance cord 3 to bend where the rigid support 8 terminates at both ends, thus bending at the two intended end points 11*a* and 11*b*. In the illustrated embodiment, for example in FIG. 4, the resistance cord 3 extends the full length of the rigid support 8 and bends where rigid support 8 terminates, between the shoulder and the neck 11*a* and 11*b*.

The resistance exercise device 7 can be used in connection with a wide variety of exercises, including, for example, any type of exercise relating to strength training, core conditioning, stability and stretching. The resistance exercise device 7 can also be used in any suitable manner. Countless exercises can be performed with the resistance exercise device 7.

As shown in FIGS. 3 and 4, for example, a standing bench press-type movement is employed during use of the present device. The support portion 4 directs the resistance cord 3 on top of the user's shoulder 11*a* and 11*b* and under the user's arm 11*c* and 11*d*, providing balanced top-and-bottom chest muscle development for the user. Thus, support portion 4 acts not only as a support for the user of the present device, it maintains a proper positioning of resistance cord 3 to provide for user comfort as well as balanced muscle development. Rigid support 8 directs resistance cord 3 to a comfortable place over the shoulder 11*a* and 11*b* and prevents resistance cord 3 from rubbing against the neck or otherwise harming the neck of the user.

As shown in the drawings, resistance cord 3 is joined at a joint 6 to form a closed loop of the present device. It is contemplated, however, the multiple resistance cords may be used in order to provide greater resistance for a user of the present device. Each resistance cord may more or less parallel the next, with the ends of each also joining at a joint to form closed loops. It is further contemplated that in some embodiments of the present invention, two or more non-looped resistance cords may be employed. In such an embodiment having, for example, two separate resistance cords, the first cord may extend from a first end of a first handle to a first end of a second handle, while the second cord may extend from a second end of a first handle to a second end of a second handle. The support portion and rigid support of the device remain more or less as described above, serving to direct the two separate resistance cords to proper locations above the shoulder and below the arm.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

The invention claimed is:

1. A resistance exercise device comprising:

at least one stretchable resistance loop;

a first handle having an opening extending longitudinally therethrough, said first handle associated with said at least one stretchable resistance loop, at least one stretchable resistance loop extending through said opening of said first handle such that movement of said first handle causes a corresponding motion of said at least one stretchable resistance loop;

a second handle having an opening extending longitudinally therethrough, said second handle associated with said at least one stretchable resistance loop, at least one stretchable resistance loop extending through said opening of said second handle such that movement of said second handle causes a corresponding motion of said at least one stretchable resistance loop; and a back support portion having first and second openings, said first opening extending along a length of a first side of said support portion and substantially along the width of an upper portion of a back of a user thereof, and said second opening extending along a length of a second side of said support portion and substantially along the width of a lower portion of said back of said user, said second side of said support portion opposing said first side of said support portion, wherein said at least one stretchable resistance loop extends through said first and second openings of said support portion, and further where said first and second openings of said support portion are located between said first and second handles, said back support portion including a rigid support and extending along at least a portion of a length of the upper portion of the back portion along the back of a user.

2. The resistance exercise device of claim 1 wherein said at least one stretchable resistance loop is a single, unitary construction.

3. The resistance exercise device of claim 1 wherein said at least one stretchable resistance loop is formed from a length of material the ends of which are joined together at a joint.

4. A resistance exercise device comprising:

a first stretchable resistance cord having first and second opposing ends;

a second stretchable resistance cord having first and second opposing ends;

a first handle, said first end of said first stretchable resistance cord being attached to an upper surface thereof, and said first end of said second stretchable resistance cord being attached to a lower surface thereof;

a second handle, said second end of said first stretchable resistance cord being attached to an upper surface thereof, and said second end of said second stretchable resistance cord being attached to a lower surface thereof; and a back support portion attached to said first and second stretchable resistance cords and extending therebetween, said back support portion including a rigid support and extending along at least a portion of a length of an upper portion of the back portion along the back of a user.

5. The resistance exercise device of claim 4, wherein said support portion comprises first and second sleeves extending along opposing ends thereof, said sleeves adapted to allow said stretchable resistance cords to move freely therethrough and to remain fixed in position when in a relaxed state.

6. The resistance exercise device of claim 1, wherein said rigid support portion directs a first length of said resistance loop above a shoulder of a user thereof and a second length of said resistance loop below an arm of said user.

7. The resistance exercise device of claim 4, wherein said rigid support portion directs a length of said first resistance cord over a shoulder of a user of thereof and a length of said second resistance cord below an arm of said user.

* * * * *